US005915850A

United States Patent [19]

Krist et al.

[11] Patent Number: 5,915,850

[45] Date of Patent: Jun. 29, 1999

[54] SUPPORT SYSTEM FOR BATH, SHOWER OR WHIRLPOOL TUBS

[75] Inventors: Dieter Krist, Winnenden; Bernd Hanel, Fellbach, both of Germany

[73] Assignee: E. Missel GmbH & Co., Stuttgart, Germany

[21] Appl. No.: 08/928,807

[22] Filed: Sep. 12, 1997

[30] Foreign Application Priority Data

Apr. 11, 1997 [DE] Germany ..... 29706518

[51] Int. Cl.[6] ..... A47K 3/16

[52] U.S. Cl. ..... 4/592; 4/595; 52/34

[58] Field of Search ..... 4/592–595, 584, 4/506; 52/34, 35

[56] References Cited

FOREIGN PATENT DOCUMENTS 3707965 9/1988 Germany ..... 4/584

*Primary Examiner*—Charles R. Eloshway

*Attorney, Agent, or Firm*—Townsend & Townsend and Crew LLP

[57] ABSTRACT

A support system for bath or shower tubs which are preferably provided with a rim, in particular a preferably extending rim has at least one upper horizontal strut (10, 12, 14, 16) to which at least one vertical strut (20–30) is secured, with an element for vertical adjustment being provided at the vertical strut. Insulating elements are provided for the decoupling of structure-borne noise and vibrations.

12 Claims, 1 Drawing Sheet

SUPPORT SYSTEM FOR BATH, SHOWER OR WHIRLPOOL TUBS

FIELD OF THE INVENTION

The present invention relates to a support system for bath tubs, shower tubs or whirlpool tubs which are provided with a rim, in particular a peripherally extending rim.

DESCRIPTION OF THE PRIOR ART

In the installation of bath, shower or whirlpool tubs a basic problem exists in that the tub must be installed in a statically safe manner with the installation taking place as quickly and simply as possible. The tub must also be walled in before or after installation or provided with dry panelling.

Finally the problem basically arises that as a result of the connections to the body of the building which result during installation bridges arise which transmit structure-borne noise, which are undesirable and which can also prevent account being taken of existing regulations and recognized technical rules with respect to installation against structure-borne noise.

OBJECT OF THE INVENTION

It is accordingly the problem (object) underlying the present invention to provide a support system for bath, shower or whirlpool tubs which permits simple and statically reliable installation of the tubs, with the tubs being installed both in a force transmitting manner but also in a manner decoupled from structure-borne noise, without it being necessary to build up beneath the tub with walling or plate material.

BRIEF DESCRIPTION OF THE INVENTION

In order to solve this problem there is provided a support system for bath, shower or whirlpool tubs which are preferably provided with a rim, in particular a preferably extending rim, comprising at least one horizontal strut, at least one vertical strut which is connected to the horizontal strut, at least one element for height adjustment which is arranged at the vertical strut; and an insulating element arranged on the horizontal strut and/or on the vertical strut for the decoupling of structure-borne noise and vibrations.

Thus at least one horizontal strut and at least one vertical strut are provided, with the vertical strut being arranged between the horizontal strut and the floor or between two horizontal struts. Although a force transmitting installation of the tub and one which at the same time is decoupled with respect to structure-borne noise first appear to contradict one another a stable mounting results in accordance with the invention which replaces the previously customary walling or plate material which is built in beneath the tub. Furthermore, at least one element for the vertical adjustment is arranged at the vertical strut in accordance with the invention whereby leveling or level compensation can be achieved. Should the floor surface not be entirely flat then the horizontal position of the horizontal strut can be adjusted in simple manner by the element for height adjustment. Finally, an insulating element for the decoupling of structure-borne noise is provided on the horizontal strut under/or on the vertical strut, whereby the transmission of sound or vibrations from the tub to the floor or to the walls is avoided.

Using the support system of the invention, bath tubs, shower tubs or whirlpool tubs can be statically reliably and safely installed in a force transmitting manner and also decoupled with respect to structure-borne noise and vibrations, without requiring a force transmitting substructure with walling, light weight concrete slabs or similar slabs stiff in bending. Through the support system of the invention the tub is already mounted in a stable manner after installation so that it can no longer tilt, even when the tub rim is loaded. The entire support system is vertically adjustable through the elements for height adjustment so that simple levelling is possible. Finally, the vertical struts in accordance with the invention can be used to support lightweight dry panelling such as lightweight boards which can be tiled or also heavier cladding elements such as for example marble slabs.

Advantageous embodiments of the invention are described in the description, the drawings and also the subordinate claims.

In accordance with a first embodiment of the invention the insulating element is formed as a substantially U-shaped or strip-like insulating section which preferably surrounds the upper horizontal section. An insulating element of this kind ensures that the tub rim which contacts the support system does not have a direct contact to the upper side or to the side surfaces of the support system. At the same time the cross-sectional shape of such an insulating section enables easy attachment of the insulating section to the horizontal section. However simple strips of soft resisting insulating material can also be used which should be arranged in such a way that contact between the tub and the horizontal strut is precluded.

In accordance with a further embodiment of the invention the element for the height adjustments can be a screw insert which is preferably capable of being locked by a counter nut. With a screw insert of this kind a level adjustment can be achieved at each vertical strut in a simple manner so that eventual unevenness of the floor or of the floor scree can be compensated.

It is particularly advantageous if fastener elements for the fastening of dry panelling are provided on the horizontal section(s) and/or on the vertical section(s). Such fastener elements can for example be installation bores or also fastener pins or bolts connected to the struts which serve for example for the attachment of marble slabs.

In order to connect horizontal struts at right angles to one another, for example in the case of a free-standing tub, a corner piece or a hinge can be provided in a further embodiment which in each case connects two horizontal struts together. In the case of a free-standing tub a total of eight corner pieces would thus connect four upper horizontal struts and four lower horizontal struts and stiffen them so that on the whole a stiff and stable frame system is provided.

In the event that the tub is to be installed in a corner or at a wall, the wall fastening elements are provided in accordance with a further embodiment of the invention which are at least partly insertable into the horizontal struts. This embodiment results on the one hand in a simple installation, in that the wall fastening elements can be connected to the horizontal struts after being inserted therein, for example screwed to them. On the other hand, length compensation is possible through the telescopic connection between the wall fastening elements and horizontal struts in order to take account of different tub dimensions or tolerances.

It is particularly advantageous when wall fastening elements are provided which are angled or cranked in order to avoid any direct contact with the tub rim.

It can also be advantageous in accordance with the invention to provide rail sections for a wall side mounting, with the wall sections being secured to the wall and supporting the corresponding tub rim via insulating elements. In the event of corner installation the tub can be installed through the use of two such rail sections and through the use of the support system of the invention without separate supporting feet having to be used.

The horizontal sections in accordance to the invention can advantageously be C-shaped or U-shaped in cross-section and consist preferably of steel. However, simpler cross sections such as angles or flat bar sections or also square tube cross-sections can be used.

DESCRIPTION OF PREFERRED EMBODIMENTS

Figure 1:
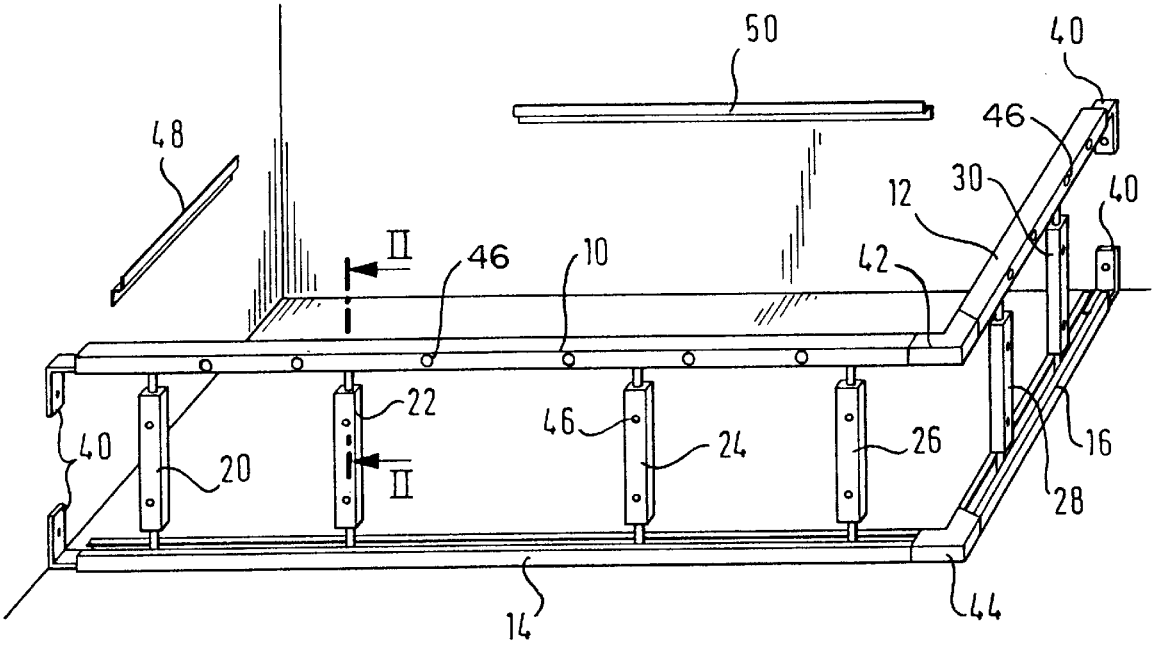
FIG. 1 is a prospective view of a tub support system by way of example, with the tub to be installed having been omitted for the sake of a simplified representation.

In the example of an installation shown in FIG. 1 there is provided a support system for a corner installation of a bath tub, with the support system having two upper horizontal struts or rails 10 and 12 and also two lower horizontal struts or rails 14 and 16. The two horizontal struts 10 and 14 are connected in the illustrated example via a total of four vertical struts 20, 22, 24 and 26. The two horizontal struts 12 and 16 located at the narrower side are connected by two further vertical struts 28 and 30.

Figure 2:
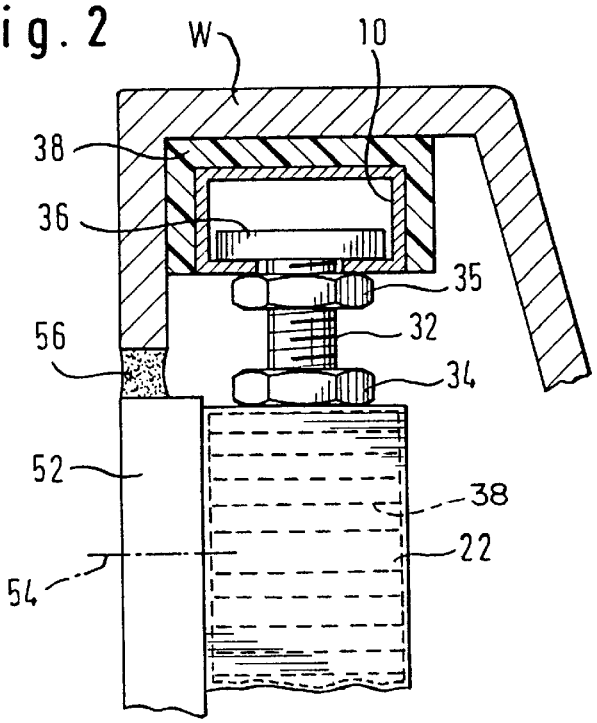
FIG. 2 is a cross sectional view along the section line II—II of FIG. 1 supplemented with the installed tub and also the dry panelling.

FIG. 2 shows in an enlarged representation the connection between the vertical struts and the horizontal struts. For this purpose a screw insert 32 is screwed into each vertical strut and can be fixed to the vertical strut by a locking nut 34. A plate 36 is formed onto the upper end of the screw insert 32 and introduced into the horizontal strut 10 which is of C-shaped cross-section. The fastening of the screw insert 32 to the horizontal strut 10 takes place through a six-sided nut 35 with a washer (not shown).

In the present example screw inserts which are formed as shown in FIG. 2 are provided at the top end and at the lower end of each vertical strut.

Wall fastening elements 40 serve for the attachment of the horizontal struts 10 to 16 to the walls. The wall fastening elements 40 are of angled shape and are capable of being telescoped and thus screwed to the wall at their one limb. The other limb of the wall fastening elements 40 is so formed that it can be introduced into the horizontal struts. At the same time fixing elements (not shown) are provided in order to connect these limbs of the wall fastening elements 40 to the associated horizontal strut.

Two corner pieces 42, 44 are provided for the preferably right angled connection of two horizontal struts to one another in the illustrated example of FIG. 1, with the corner piece 42 connecting the upper horizontal struts 10 and 12 together rigidly and with the lower corner piece 44 connecting the lower horizontal struts 14 and 16 together rigidly, or via a hinge.

As indicated in FIG. 1 fastener elements 46 are provided at each vertical strut and/or each horinzontal strut and facilitate the attachment of dry panelling. Furthermore, a rail section 48 and 50 is provided at each wall whereby a transverse tub rim can be inserted into the rail section 48 and a longitudinal side tub rim can be inserted in the rail section 50.

As FIG. 2 shows the upper horizontal struts 10 and 12 are provided with an insulating element which is formed as a substantially U-shaped insulating section 38. This insulating section 38 is so placed or adhesively bonded onto the two upper horizontal struts 10 and 12 so that it fully surrounds the upper side and side faces of the horizontal struts. In FIG. 2 the tub W to be installed is placed onto the support system and lies with its tub rim on the upper side of the insulating section 38 and also against the outer side limb of the latter. A skirt 52 (dry panelling) is secured to the vertical struts via fastener means 54 which are only schematically indicated. A silicon seal 56 is provided between the tub W and the upper side of the skirt 52.

For the installation of the support system of the invention the plates 36 of the screw inserts 32 of the vertical struts 22 to 26 are first introduced into the slots of the horizontal struts 10 and 14 which are of C-shaped cross-section, whereby the horizontal struts are connected to the vertical struts. The same applies to the connection of the horizontal struts 12 and 16 to the vertical struts 28 and 30. After the installation of the wall rail sections 48 and 50 and also the wall attachments 40 the free limbs of the wall attachments 40 are introduced into the horizontal struts and fixed after alignment of the strut system. Through the telescopic installation of the limbs of the wall attachments into the horizontal struts a length compensation can also be achieved for tubs of different sizes. The support system of the invention is finished after connection of the upper horizontal struts 10 and 12 with the corner piece 42 and of the lower horizontal struts 14 and 16 with the corner piece 44.

After the installation of the tub W into the support system, this is statically reliably held in a force transmitting manner and decoupled with respect to structure-borne noise without it being necessary to build a wall beneath the outer room-side of the tub. An appropriate dry panelling 52 can easily be secured to the vertical struts 20 to 30, or also to the horizontal struts 10 to 16, as a result of the fastener elements 46. After sealing the remaining gaps with silicon 56 the tub is fully installed.

Furthermore, an angled piece of insulating material can be provided for decoupling between the tub rim and the wall, with an additional rubber insert being worked into the angled piece at the inner side of one limb. In this way, the decoupling with respect to structure-borne noise and vibration is significantly improved.

We claim:

1. A support system for bath, shower or whirlpool tubs comprising:

at least one horizontal strut;

at least one vertical strut which is connected to the horizontal strut;

at least one element for height adjustment which is arranged at the vertical strut;

an insulating element arranged on at least one of the horizontal strut and the vertical strut for the decoupling of structure-borne noise and vibrations; and a wall attachment element telescopically received in a terminal end of each horizontal strut for connecting the end of each horizontal strut to a wall.

2. A support system in accordance with claim 1, wherein the insulating element is formed as a substantially U-shaped insulating section.

3. A support system in accordance with claim 2, wherein the substantially U-shaped insulating section surrounds the at least one horizontal strut.

4. A support system in accordance with claim 1, wherein the element for the height adjustment is a screw insert.

5. A support system in accordance with claim 4, wherein the screw insert is capable of being locked by a counter nut.

6. A support system in accordance with claim 1, wherein fastener elements are provided at at least one of the at least one horizontal strut and the at least one vertical strut for the attachment of dry paneling.

7. A support system in accordance with claim 1, wherein two respective horizontal struts are connected together via a corner piece or via a hinge.

8. A support system in accordance with claim 1, wherein wall fastening elements are provided which are angled or cranked in order to avoid a contact with a tub rim.

9. A support system in accordance with claim 1, wherein rail sections are provided for a wall side tub mounting.

10. A support system in accordance with claim 1, wherein the at least one horizontal strut is of C-shaped cross-section.

11. A support system in accordance with claim 10, wherein the at least one horizontal strut consists of steel.

12. A support system in accordance with claim 1, wherein two horizontal struts and a plurality of vertical struts are provided for each tub side and are respectively connected together.

* * * * *